US009546544B2

(12) United States Patent
Al-Badran

(10) Patent No.: US 9,546,544 B2
(45) Date of Patent: Jan. 17, 2017

(54) APPARATUS FOR DRIVING AND MANEUVERING WIRELINE LOGGING TOOLS IN HIGH-ANGLED WELLS

(71) Applicant: Saudi Arabian Oil Company, Dhahran (SA)

(72) Inventor: Mohammed Saud Al-Badran, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 250 days.

(21) Appl. No.: 14/245,280

(22) Filed: Apr. 4, 2014

(65) Prior Publication Data

US 2014/0311755 A1 Oct. 23, 2014

Related U.S. Application Data

(60) Provisional application No. 61/812,985, filed on Apr. 17, 2013.

(51) Int. Cl.

| | |
|---|---|
| ***E21B 47/00*** | (2012.01) |
| ***E21B 23/14*** | (2006.01) |
| *E21B 23/00* | (2006.01) |

(52) U.S. Cl.

CPC ..... *E21B 47/00* (2013.01); *E21B 23/14* (2013.01); *E21B 2023/008* (2013.01)

(58) Field of Classification Search

USPC ..... 166/381, 66

See application file for complete search history.

(56) References Cited

U.S. PATENT DOCUMENTS

| | | | |
|---|---|---|---|
| 4,523,644 | A | 6/1985 | Dismukes |
| 4,616,719 | A | 10/1986 | Dismukes |
| 4,676,310 | A | 6/1987 | Scherbatskoy |
| 4,897,646 | A | 1/1990 | Goodwill et al. |
| 5,031,719 | A | 7/1991 | Baria et al. |

(Continued)

FOREIGN PATENT DOCUMENTS

| | | | |
|---|---|---|---|
| EP | 2458137 | A1 | 5/2012 |
| GB | 2352041 | A | 1/2001 |

OTHER PUBLICATIONS

PCT/US2014/032934, International Search Report and Written Opinion, Jan. 27, 2015 (9 pages).

*Primary Examiner* — Taras P Bemko

(74) *Attorney, Agent, or Firm* — Abelman, Frayne & Schwab

(57) ABSTRACT

A data logging apparatus for use in a wellbore of a fluid production well includes a forward portion for guiding the data logging tool through the wellbore. An elongated body having a first end and a second end includes electronic circuitry for receiving data from at least one sensor provided on the data logging tool. An elongated shaft having a first end is connected to the forward portion, and a second end of the elongated shaft is connected to the first end of the elongated body. A propulsion assembly is connected to the second end of the elongated body for self-propelling the data logging tool through the fluid production well. The self-propelled data logging tool can transverse though the wellbore having inclinations of at least fifty degrees. An outwardly extending support arm assembly is rotatably attached about the elongated shaft to prevent the logging tool from uncontrollably spinning.

7 Claims, 4 Drawing Sheets

(56) References Cited

U.S. PATENT DOCUMENTS

| | | | | |
|---|---|---|---|---|
| 5,253,713 | A | 10/1993 | Gregg et al. | |
| 5,864,099 | A | 1/1999 | Wittrisch et al. | |
| 6,405,798 | B1 | 6/2002 | Barrett et al. | |
| 6,488,085 | B1 | 12/2002 | Milne et al. | |
| 6,763,899 | B1 | 7/2004 | Ossia et al. | |
| 6,857,486 | B2 | 2/2005 | Chitwood et al. | |
| 6,880,195 | B1 | 4/2005 | Bahari et al. | |
| 6,971,265 | B1 * | 12/2005 | Sheppard | E21B 47/011 166/255.1 |
| 7,055,625 | B1 | 6/2006 | Myrick et al. | |
| 7,597,143 | B2 | 10/2009 | Giacomino | |
| 7,690,425 | B2 | 4/2010 | Giacomino | |
| 8,051,928 | B2 | 11/2011 | Stroud et al. | |
| 2003/0141078 | A1 | 7/2003 | Mackenzie | |
| 2008/0061188 | A1 * | 3/2008 | Morris | F42B 10/54 244/3.23 |

* cited by examiner

APPARATUS FOR DRIVING AND MANEUVERING WIRELINE LOGGING TOOLS IN HIGH-ANGLED WELLS

CROSS REFERENCE TO RELATED APPLICATION

This patent application claims the benefit of U.S. Provisional Application No. 61/812,985, filed Apr. 17, 2013, the content of which is incorporated by reference herein in its entirety.

FIELD OF THE INVENTION

The present invention relates to well logging tools in hydrocarbon production wells, and more specifically to a data logging tool capable of detecting conditions of a wellbore with inclinations exceeding approximately fifty degrees.

BACKGROUND OF THE INVENTION

Drilling and production organizations operate data logging tools in their hydrocarbon production wells on a periodic basis to determine the down-hole ambient conditions in the well. The information recorded by the data logging tools is useful to determine oil and gas reserves and production plans.

Referring to FIG. 1, an illustrative prior art hydrocarbon production field 100 is shown. The field 100 illustratively depicts a slant-hole drilling well 102 and a horizontal drilling well 104. These types of wells include one or more curved portions which are directed to reach a target reservoir 112 that are not located directly below the drill site. Slant-hole wells 102 and horizontal wells 104 allows the driller to reach targeted reservoirs 112 that are not easily accessible due to geographical constraints (e.g., a marsh or lake), man-made constraints (e.g., environmentally protected areas), or shallow hydrocarbon reservoirs, any of which limit or otherwise prohibit a vertical drill site from being positioned directly above the target reservoir. Advantageously, directional drilling helps enable access to difficult-to-reach reservoirs 112 and allows the reservoirs to be drained more efficiently.

Slant-hole wells 102 and horizontal wells 104 each include a borehole or wellbore 106 having an initial vertical wellbore portion 108 and a curved wellbore portion 110, which directs the borehole 106 away from the vertical wellbore portion 108. The curved portion 110 can have a bend or curvature such that the drill will turn up to ninety degrees, as illustratively shown for the horizontal well 104 in FIG. 1. The curved portion 110 can be formed within a few feet in the horizontal well 104, while the slant-hole well 102 can make a turn that takes tens or hundreds or even thousands of feet to complete the turn.

Logging tools are primarily used to sense, monitor and obtain (i.e., record and/or transmit) data from the well, including data associated with the formation layers of the well and the wellbore's environmental conditions, which can be used for further analysis and/or determination of alarm conditions. The logging tools can also be used to perforate or plug reservoirs. In vertical wells, logging is typically performed by using a wireline attached to the logging tool. Alternatively, for wells having high-angled inclinations, implementing data logging tools in the wellbore is typically accomplished by using coiled tubing and/or drill piping which can be controlled by a rig or tractor system located at the surface of the drilling site.

The prior art logging tools can be cumbersome to implement in a wellbore 106. Therefore, there is a need for a self-driven and faster logging tool. Further, there is a need for an efficient driving tool that can propel or otherwise drive a logging tool that is attached to a wireline through a fluid-filled well. Moreover, there is a need for a self-propelled logging tool that can be easily provided in a well bore without having to use drill piping, coiled tubing and/or a tractor system which are less efficient and expensive to implement. Further, there is a need for a data logging tool that can traverse a well, e.g., a hydrocarbon production well, having inclinations greater than fifty degrees.

SUMMARY OF THE INVENTION

In accordance with the present invention, a self-propelled data logging tool or apparatus is disclosed. The data logging apparatus includes an electrically powered motor that rotates a propeller or impeller provided at the end of the data logging apparatus to push or otherwise propel the data logging apparatus through the hydrocarbon fluids in the production well. Advantageously, the self-propelled data logging apparatus can traverse through the wellbore and the production well fluids at angles greater than fifty degrees with respect to a vertical down hole.

In one embodiment, a data logging apparatus for use in a wellbore of a fluid production well comprises a forward portion for guiding the data logging apparatus through the wellbore of the fluid production well; an elongated body having a first end and a second end includes electronic circuitry for receiving data from at least one sensor provided on the data logging apparatus. An elongated shaft having a first end is connected to the forward portion, and a second end is connected to the first end of the elongated body. A propulsion assembly is connected to the second end of the elongated body for self-propelling the data logging apparatus through the fluid production well.

In one aspect, the propulsion assembly comprises a motor coupled to the second end of the elongated body, a rotatable shaft extending rearwardly from the motor, and a first propeller coupled to a free end of the rotatable shaft. The motor of the propulsion assembly is configured to receive electrical power from a power supply. In an aspect, the motor of the propulsion assembly receives electrical power from a remote power source via a power cable. In another aspect, a power connector is coupled to the motor and configured to receive power from the power cable. The power cable can extend substantially rearwardly from the data logging apparatus and to the surface of the fluid production well.

In one aspect, at least a portion of the wellbore has an inclination of at least fifty degrees.

In yet another aspect, the data logging apparatus further comprises a counter-spin assembly rotatably secured to the elongated shaft. The counter-spin assembly can include a plurality of arms extending substantially normal to a longitudinal axis of the elongate shaft. Further, the plurality of arms can extend equidistance between each other along the longitudinal axis of the elongate shaft. Additionally, the plurality of arms can extend outwardly towards an interior wall surface of the wellbore. In one aspect, the plurality of arms can extend to or substantially to the interior wall surface of the wellbore.

In one aspect, each of the plurality of arms is affixed to one or more hubs which are rotatably mounted about the elongated shaft. In still another aspect, the one or more hubs are configured to enable forward and backward movement of the counter-spin assembly longitudinally along the elongate shaft. In yet another aspect, the one or more hubs comprise first and second hubs which are rotatably mounted about the elongated shaft distally apart. Each of the plurality of arms has a first end affixed to the first hub and a second end affixed to the second hub.

In yet another aspect, the counter-spin assembly comprises a turbine assembly rotatably secured over the elongated shaft. The turbine assembly can include a plurality of blades extending substantially normal to a longitudinal axis of the elongate shaft. Preferably, each of the plurality of blades is spaced equidistance apart. In one aspect, the each of the plurality of blades extends outwardly to an interior wall surface of the wellbore. In another aspect, each of the plurality of blades is affixed to a central hub which is rotatably mounted about the elongated shaft. In yet another aspect, the turbine assembly is configured to move forward and rearward along a longitudinal axis of the elongated shaft.

In one aspect, the turbine assembly rotates freely about the elongated shaft. Alternatively, the turbine assembly further comprises a second motor configured to rotate the plurality of blades about the elongated shaft. In yet another aspect, the propulsion assembly is configured to rotate the plurality of blades of the turbine assembly about the elongated shaft.

In another embodiment, a method is provided for propelling a data logging apparatus in a wellbore of a fluid production well, where the data logging apparatus includes a forward portion for guiding the data logging apparatus through the wellbore, an elongated body having a first end and a second end, an elongated shaft having a first end connected to the forward portion and a second end connected to the first end of the elongated body, and a motorized propulsion assembly connected to the second end of the elongated body for self-propelling the data logging apparatus through the wellbore, and where the method comprises the steps of lowering the data logging apparatus into the wellbore of the fluid production well; providing power to a motor of the propulsion assembly via a wireline cable; propelling the data logging apparatus via a propeller, which is rotatably attached to and extends rearwardly from the motorized propulsion assembly; and counteracting rotational spin of the data logging apparatus caused by the propulsion assembly by rotating a counter-spin assembly, which is rotatably attached along at least a portion of the elongated shaft, in an opposite rotational direction as the propeller rotates.

BRIEF DESCRIPTION OF THE DRAWINGS

The invention will be further described below and with reference to the attached drawings in which.

Figure 1:
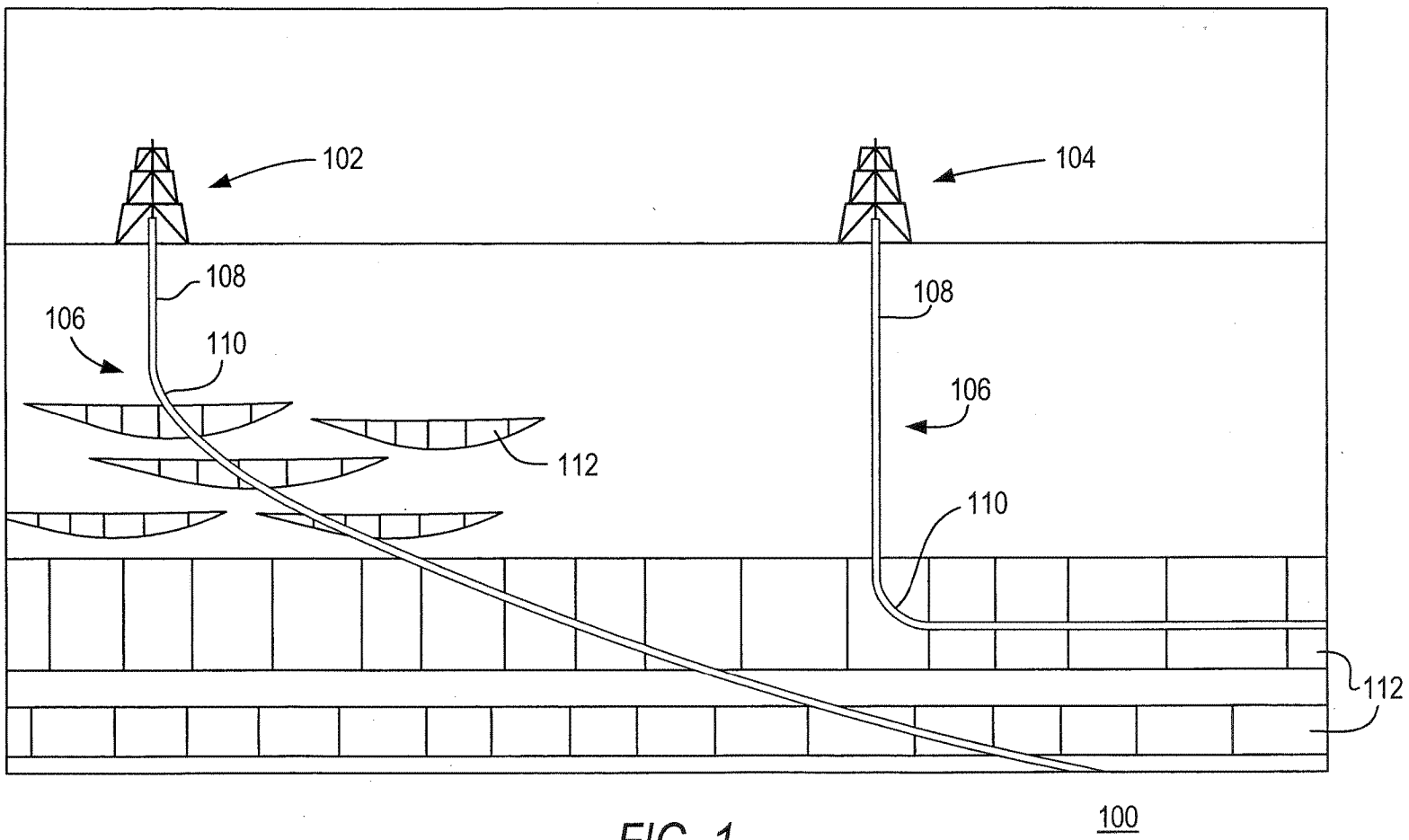
FIG. 1 (PRIOR ART)
FIG. 1 is a schematic view of an illustrative prior art hydrocarbon production field having a slant-hole well and a horizontal well.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE PREFERRED EMBODIMENT

The present invention relates to a data logging tool or apparatus having an electric turbo motor which can self-propel, i.e., drive the well logging apparatus in hydrocarbon production wells. Advantageously, the self-propelled data logging apparatus of the present invention is capable of detecting environmental conditions while navigating through a wellbore having inclinations or turns exceeding approximately fifty degrees.

Figure 2:
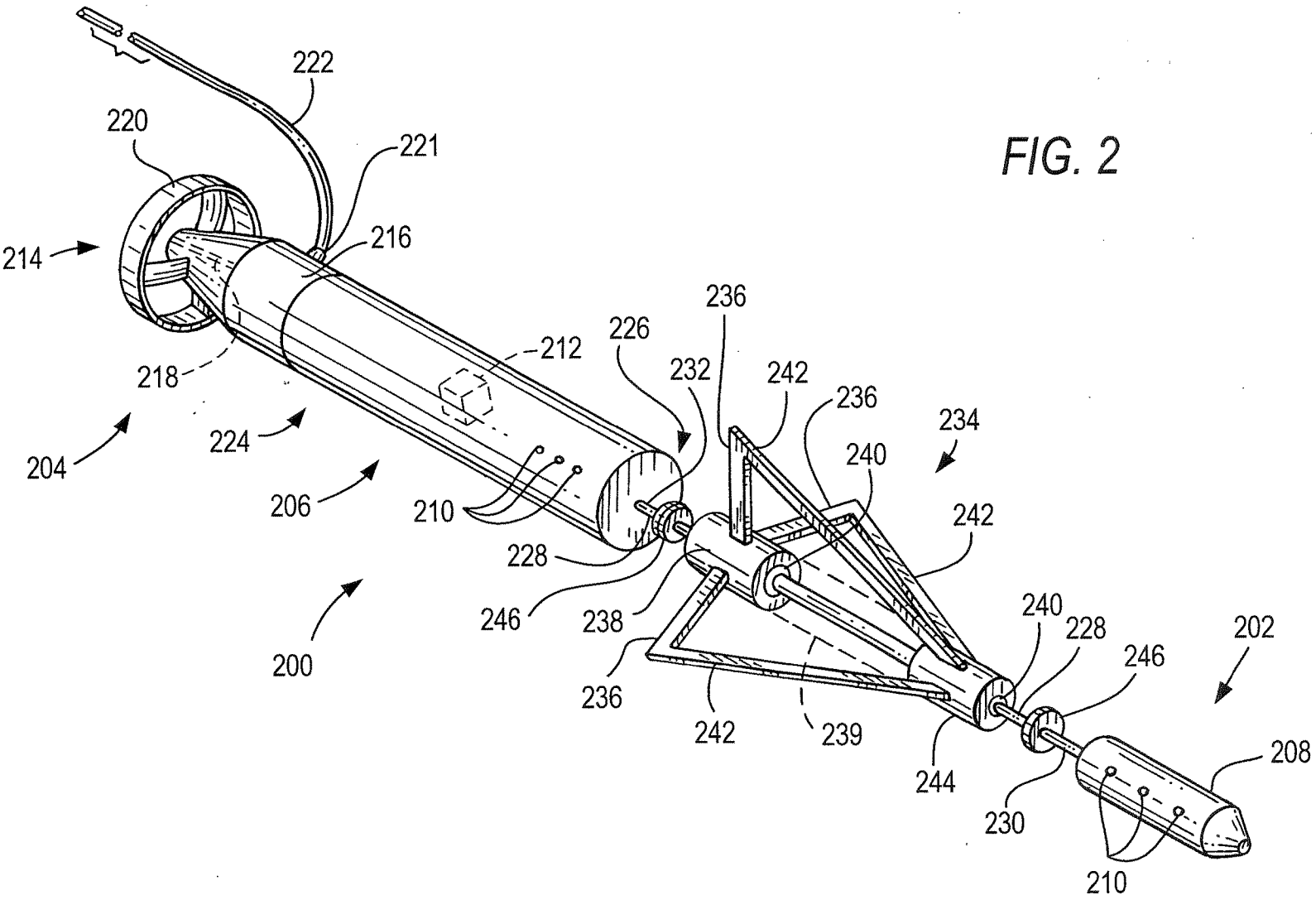
FIG. 2 is a front perspective view of a first embodiment of a data logging apparatus of the present invention.

Referring now to FIG. 2, there is shown a first embodiment of a motor driven data logging apparatus 200 suitable for use in a hydrocarbon fluid production well having a wellbore 106 with inclinations greater than fifty degrees relative to the vertical wellbore portion 108 of the drilling site. The data logging apparatus 200 is elongated in shape with a forward end 202 having a sensor assembly 208 that houses or otherwise facilitates a plurality of sensors 210 for monitoring environmental conditions in the wellbore. An elongated body 206 serves as a housing for retaining different types of electronic logging devices 212 (drawn in phantom), which can include and/or be coupled to memory devices, sensors 210, as well as communication devices and links for storing and transferring data signals from the sensors 210. A propulsion assembly 214 of the present invention is positioned at a rear end 204 of the data logging apparatus 200.

Preferably, the propulsion assembly 214 (i.e., "turbo motor") is positioned at a rear end 224 of the elongated body 206. The propulsion assembly 214 includes an electric motor 216, a rotating drive shaft (shown in phantom) 218 and a propeller (or impeller) 220. A proximal end of the drive shaft 218 is rotatably coupled to the electric motor 216, and a distal free end of the drive shaft 218 is fixedly attached to the propeller 220, which extends most rearwardly along the longitudinal axis of and to push the data logging apparatus 200 through the fluids in the wellbore 106. Alternatively, the propulsion assembly is positioned proximate or at the front end 226 of the elongated body 206 as illustratively shown and discussed below with respect to the embodiment of FIG. 4.

The logging apparatus 200 is initially positioned within the casing of the wellbore 106 from the surface above, and is capable of descending or ascending therein during the logging operations. The logging apparatus 200 is suspended inside of the casing by a logging cable 222, which provides electrical power and communication channels from the surface equipment. As illustratively shown in FIG. 2, power is provided locally to the electric motor 216 of the logging apparatus 200 via the logging cable 222 from a logging truck or other power generator which is located at the surface of the well. Specifically, power is provided from the logging cable 222 to a connection point 221 of the motor 216. Preferably, the connection point 221 has swivel and/or rotational capabilities to help prevent twisting and/or entanglement of the logging cable 222. The motor 216 rotates the propeller 220 to propel the data logging apparatus 200 through the fluids in the wellbore 106.

The front portion 202 of the data logging apparatus 200 includes a bull nose and/or sensor housing 208 connected to a front end 226 of the elongate body 206 via an elongated shaft 228. The bull nose 208 preferably includes a conicalshaped forward portion, although such shape is not considered limiting, and can be fabricated from a fluid impervious and impact resistant material, such as stainless steel, ceramics, and the like. The bull nose 208 assists in guiding the logging apparatus 200 through the borehole 106, especially when undergoing changes in Azimuth and inclination. The bull nose 208 can also include one or more sensors 210. A front end 230 of the elongated shaft 228 is secured (e.g., fixedly attached) to the sensor housing 208, and the rear end 232 of the elongated shaft 228 is secured (e.g., fixedly attached) to the front end 226 of the elongated body 206. In one embodiment, the elongated shaft 228 can be a tubular steel pipe which serves as a conduit for communication links that can extend between the one or more sensors 210 in the bull nose 208 and the electronic devices 212 housed in the body 206. The elongated shaft 228 serves as a support structure for a rotatable counter-spin assembly 234, which is used to help prevent the data logging apparatus 200 from rotating from the rotational forces of the propeller 220 during movement through the wellbore fluid.

Referring to FIG. 2, in one embodiment the counter-spin assembly 234 includes a plurality of arms 236 that extend outwardly towards or substantially to the interior wall of the wellbore 106 in a substantially normal direction with respect to the longitudinal axis of the elongated shaft 228. The support arms 236 are preferably spaced equidistance apart from each other. A first end of the support arms 236 are fixedly attached to a first hub member 238. The first hub member 238 has an exterior portion configured to fixedly retain the support arms 236, and an interior portion which is sized and configured to rotatably and slidably mount and/or circumscribe about the exterior surface of the elongated shaft 228. One or more ball bearing races or rollers 240 can be provided between the exterior surface of the elongated shaft 228 and the interior surface of the first hub member 238 to reduce frictional forces and further enhance the free longitudinal movement of the counter-spin assembly 234 about the elongated shaft 228. Advantageously, the free longitudinal movement of the counter-spin assembly 234 enables the logging apparatus 202 to better navigate through turns, e.g., elongated turns or dogleg turns of the wellbore 106. In this manner, the logging apparatus 202 will better avoid getting lodged or otherwise stuck along a turn in the wellbore 106.

At least two support arms 236 extend radially outward from the elongated shaft 228 and are spaced one-hundred and eighty degrees apart from each other. As illustratively shown in FIG. 2, three support arms 236 extend radially outward from the elongated shaft 228 and are spaced equidistantly apart by 120 degrees from each other, although the number of support arms 236 and corresponding spacing therebetween is not considered limiting. The plurality of support arms 236 are extended equidistance outward a length to approximately reach the interior surface of the adjacent wellbore 106. In this manner, the data logging apparatus 200 is maintained substantially central within the wellbore 106 as it moves through the fluid therein. A person of ordinary skill in the art will appreciate that the plurality of support arms 236 extend a sufficient length towards or to the interior wall of the wellbore 106 to keep the data logging apparatus 200 substantially centered within the wellbore 106 without getting wedged, lodged or otherwise stuck therein (e.g., while making a turn).

The rotating support arms 236 are provided to reduce spinning of the data logging apparatus 200 while the data logging apparatus 200 is propelled through the fluid in the wellbore 106. However, there will be some drag caused by the rotating support arms due to the frictional forces against the interior wall of the wellbore 106. Preferably, drag caused by the support arms 236 is reduced by providing an inwardly directed angled member 242 from the distal end of each support arm 236 to a second slidable and rotatable hub member 244, which is distally spaced from the first rotatable hub member 238. The first and second hubs 238, 244 spin in unison with the plurality of support arms 236 in a rotational direction opposite that of the propeller 220. Moreover, one or more ball bearing races or rollers 240 can be provided between the exterior surface of the elongated shaft 228 an the interior surface of the second hub member 244 to reduce frictional forces and further enhance the free longitudinal movement of the counter-spin assembly 234 about the elongated shaft 228. The longitudinal movement of the counter-spin assembly 234 enables the data logging apparatus 200 to navigate turns in the wellbore 106. Although a pair of hubs (i.e., first hub 238 and second hub 244) are illustratively shown in FIG. 2, a person of ordinary skill in the art will appreciate that a single hub 239 (illustratively shown in phantom as connecting the first and second hubs as an integral hub) can be provided with the first and second ends of each arm attached to respective opposing ends of the single hub 239.

Figure 3:
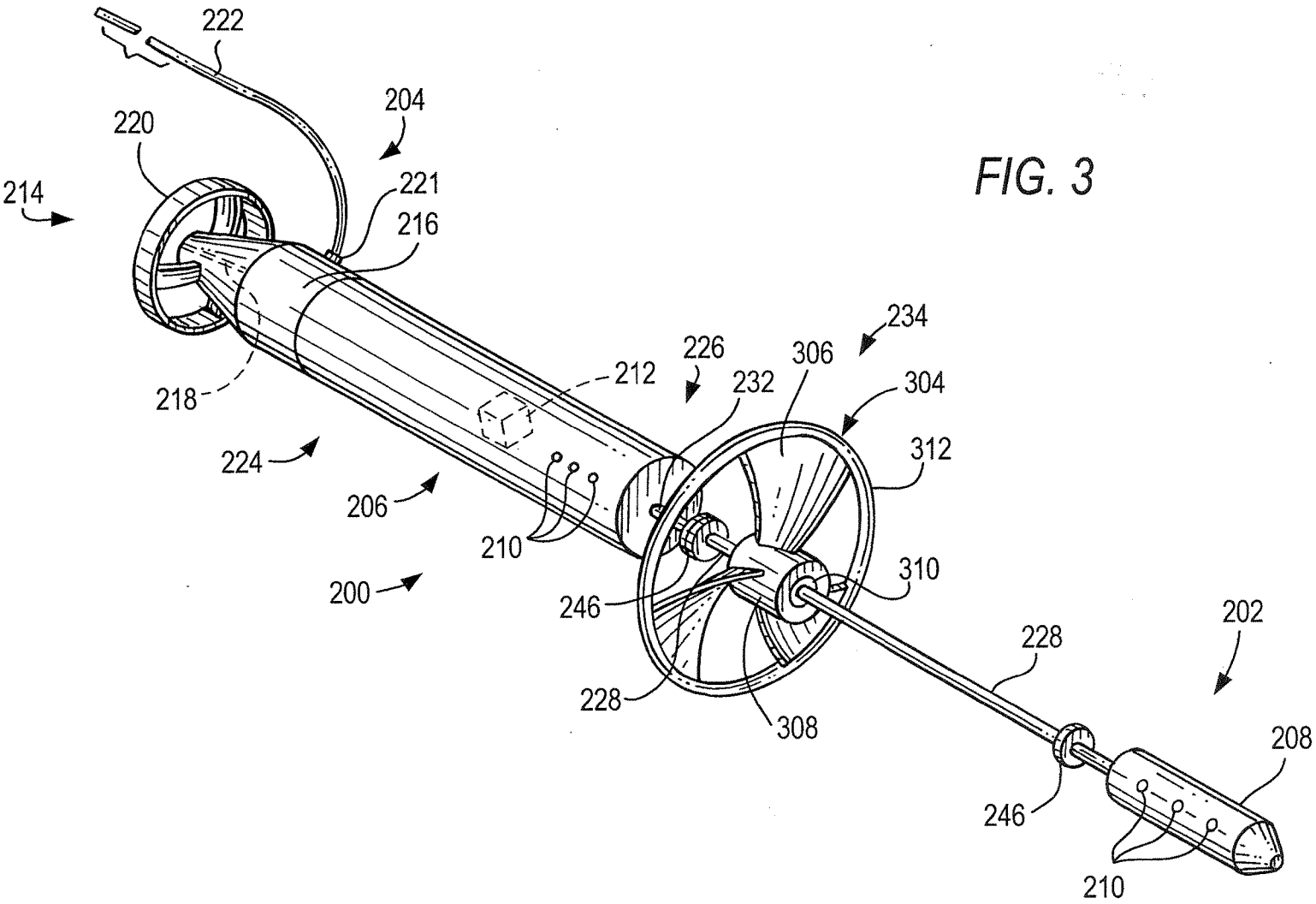
FIG. 3 is a front perspective view of a second embodiment of a data logging apparatus of the present invention.

Referring to FIG. 3, an alternative embodiment of the counter-spin assembly 234 includes a turbine assembly 304. The turbine assembly 304 includes a central hub 308, an outer shield 312, and a plurality of blades 306 extending between the central hub 308 and outer shield 312. The central hub 308 includes a longitudinal bore 310 sized to receive the elongated shaft 228, and can include bearings or rollers to reduce frictional forces between the hub 308 and shaft 228 as described above with respect to FIG. 2. The shield 312 is circular with a diameter that is sized to extend proximate the interior surface wall of the wellbore 106, although the diameter is not considered limiting. A person of ordinary skill in the art will appreciate that the diameter of the outer shield 312 is of sufficient length to keep the data logging apparatus 200 substantially centered within the wellbore 106 without getting wedged, jammed or otherwise stuck therein. The plurality of blades 306 extending between the hub 308 and shield 312 are shaped to rotate in a direction opposite of the propeller blade 220. For example, if the propeller 220 spins clockwise, then the turbine assembly 304 will have a tendency to spin in a counter-clockwise direction.

In either of the embodiments of FIGS. 2 and 3, the counter-spin assembly 234 freely rotates without electrical power provided thereto and in a direction opposite to that of the propeller 220 of the propulsion assembly 214. Advantageously, the counter-spin assembly 234 helps to counteract against spinning of the logging apparatus 200, and thereby helps reduce or eliminate undesirable torsional and other forces which can be exerted on the cable (wireline) 222 while being propelled through the wellbore 106.

Preferably, a pair of collars 246 (e.g., rings, flanges, pins among other stops) is provided on opposing sides of the counter-spin assembly 234 to prevent the counter-spin assembly 234 from sliding forward and contacting the sensor housing 208 or sliding aft and contacting the body 212 of the data logging apparatus 200. The number of collars 246 is not considered limiting and can be formed integrally with the elongated shaft 228 or as separate add-on components which are threaded or otherwise secured in a fixed position along the longitudinal axis of the elongated shaft 228. In an alternative embodiment, the counter-spin assembly 234 is rotatably attached at a predetermined position along the elongated shaft 228. In this embodiment, the counter-spin assembly 234 is locked or otherwise retained at a fixed position to prevent sliding along the longitudinal axis of the elongated shaft 228, while still rotating freely at the fixed position. An advantage of locking the counter-spin assembly 234 at a fixed position includes helping to reduce/eliminate undesirable torsional forces or other forces exerted on the logging cable 222 as the logging apparatus 200 is propelled through the wellbore 106.

The external components of the data logging apparatus 200 are subject to exposure to the fluid environment in the wellbore 106. The external components, including the elongated body 206, elongated shaft 228, sensor housing 208 and counter-spin assembly 234, are preferably fabricated from waterproof, non-corrosive materials such as stainless steel, ceramic materials and the like.

As will be understood from the above description, the data logging apparatus 200 of the present invention includes a propulsion assembly to self-propel the apparatus 200 through the fluids in the wellbore 106. Further, a counter-spin assembly 234 is provided to stabilize the data logging apparatus 200 while being propelled, prevent undesired coiling of the power cable, and makes it less expensive to operate than implementing the drill pipe and coiled tubing mounted logging tools of the prior art. This apparatus and its method of use meet all of the objectives identified above and constitutes a significant improvement over the devices and methods of the prior art.

Variations in the embodiments describe above can be implemented as well. For example, a second turbo motor can be added towards front end of the housing of the logging apparatus to rotate in an opposite rotational direction of the rear turbo motor. Accordingly, the forward turbo motor can be implemented to minimize spinning of the logging apparatus without using the counter spin arms 234.

Figure 4:
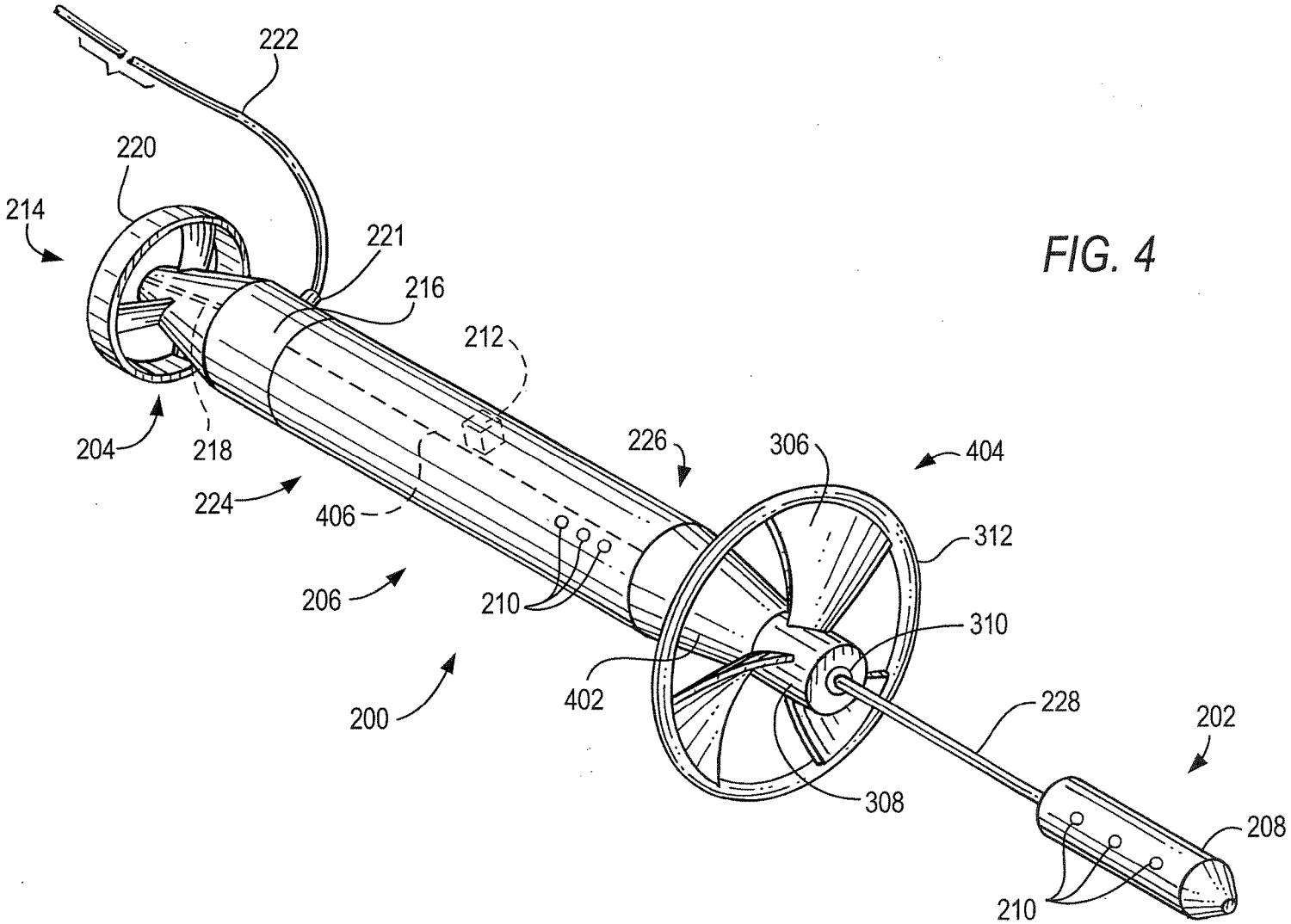
FIG. 4 is a front perspective view of a third embodiment of a data logging apparatus of the present invention.

Referring now to FIG. 4, a front perspective view of a third embodiment of a data logging apparatus 200 of the present invention is illustratively shown. The embodiment of FIG. 4 is the same as the embodiment of FIG. 3, except that a turbine assembly 404 provided at the front end 226 of the elongated housing 212 is power driven by a second motor 402. The second motor 402 receives electrical power from the power cable 222 via conductor 406 (illustratively shown in phantom). Although the second motor 402 is shown as being separate and apart from the rear motor 216, a person of ordinary skill in the art will appreciate a single motor housing having opposing dual propellers can also be implemented.

The second turbine assembly 404 is rotationally attached at the forward end 226 of the elongated housing 212 and spins about the stationary elongated shaft 228 in a rotational direction opposite to that of the rear propulsion assembly 214. In the present embodiment, the turbine assembly 404 is restricted from sliding along the longitudinal axis of the elongated shaft 228. In particular, the turbine assembly 404 is positioned stationary along the longitudinal axis of the elongated shaft 228 as compared to the slidable longitudinal motion of the turbine assembly 304 in the second embodiment of FIG. 3. Accordingly, the second turbine assembly 404 is provided in a similar manner to the counter-spin assembly of FIG. 3. That is, the second turbine assembly 404 helps stabilize the data logging apparatus 200 while being propelled, prevents undesired coiling of the power cable, and makes it less expensive to operate than implementing the drill pipe and coiled tubing mounted logging tools of the prior art.

As will be apparent to one of ordinary skill in the art from the above description, other embodiments can be derived by obvious modifications and variations of the apparatus and methods disclosed. The scope of the invention is therefore to be determined by the claims that follow.

I claim:

1. A data logging apparatus for use in a wellbore of a fluid production well comprising:

a forward portion for guiding the data logging tool through the wellbore of the fluid production well;

an elongated body having a first end and a second end and including electronic circuitry for receiving data from at least one sensor provided on the data logging tool;

an elongated shaft having a longitudinal axis and a first end connected to the forward portion, and a second end connected to the first end of the elongated body;

a propulsion assembly connected to the second end of the elongated body for self-propelling the data logging tool through the fluid production well; and a counter-spin assembly rotatably secured to the elongated shaft, wherein the counter-spin assembly includes a plurality of arms extending substantially normal to the longitudinal axis of the elongated shaft, and first and second hubs rotatably mounted and axially spaced apart from each other on the elongated shaft, wherein each of the plurality of arms have a first end affixed to the first hub and a second end affixed to the second hub.

2. The apparatus of claim 1, wherein the propulsion assembly comprises a motor coupled to the second end of the elongated body, a rotatable shaft extending rearwardly from the motor, and a first propeller coupled to a free end of the rotatable shaft.

3. The apparatus of claim 2, wherein the motor of the propulsion assembly is an electric motor configured to receive electrical power from a remote electrical power source via a power cable.

4. The apparatus of claim 1, wherein the power cable extends substantially rearwardly from the data logging tool and to the surface of the fluid production well.

5. The apparatus of claim 1, wherein the plurality of arms are circumferentially spaced apart equidistance between each other.

6. The apparatus of claim 1, wherein the plurality of arms are extendible outwardly to an interior wall surface of the wellbore.

7. The apparatus of claim 1, wherein at least one of said hubs is configured to enable forward and backward movement of the counter-spin assembly longitudinally along the elongated shaft.

* * * * *